United States Patent [19]

Patil et al.

[11] 4,301,742

[45] Nov. 24, 1981

[54] PARTITION SHEET TO SIDE SHEET CONNECTION FOR COVERED HOPPER CARS

[75] Inventors: Babgaunda Patil, Birmingham, Ala.; Phillip G. Przybylinski, Schereville; Roger D. Sims, Munster, both of Ind.

[73] Assignee: Pullman Incorporated, Chicago, Ill.

[21] Appl. No.: 118,137

[22] Filed: Feb. 4, 1980

[51] Int. Cl.[3] ..... B61D 7/00; B61D 17/00

[52] U.S. Cl. ..... 105/406 R; 105/409

[58] Field of Search ..... 105/406 R, 282 R, 409, 105/416, 419, 245; 296/183, 187, 191, 203

[56] References Cited

U.S. PATENT DOCUMENTS

| | | | |
|---|---|---|---|
| 1,531,761 | 3/1925 | Seiders | 105/406 R |
| 1,630,001 | 5/1927 | Gardner | 105/406 R |
| 2,754,770 | 7/1956 | Cooke | 105/406 R |
| 2,987,014 | 6/1961 | Sleeman | 105/406 R |
| 3,421,453 | 1/1969 | Allen et al. | 105/406 R |
| 3,572,252 | 3/1971 | Coover et al. | 105/406 R |
| 3,789,773 | 2/1974 | McNally et al. | 105/409 |
| 4,246,849 | 1/1981 | Gramse | 105/406 R |

*Primary Examiner*—Richard A. Bertsch

*Attorney, Agent, or Firm*—Paul A. Kerstein

[57] ABSTRACT

A covered railway hopper car includes a plurality of vertical partition sheets connected to the side walls of the car to form a plurality of hoppers. The connection of the vertical edges of the partition sheets to the inner surfaces of the side walls includes vertical posts of a cross-sectional configuration reducing stress concentration of the partition to prevent fracture.

14 Claims, 4 Drawing Figures

FIG. 1
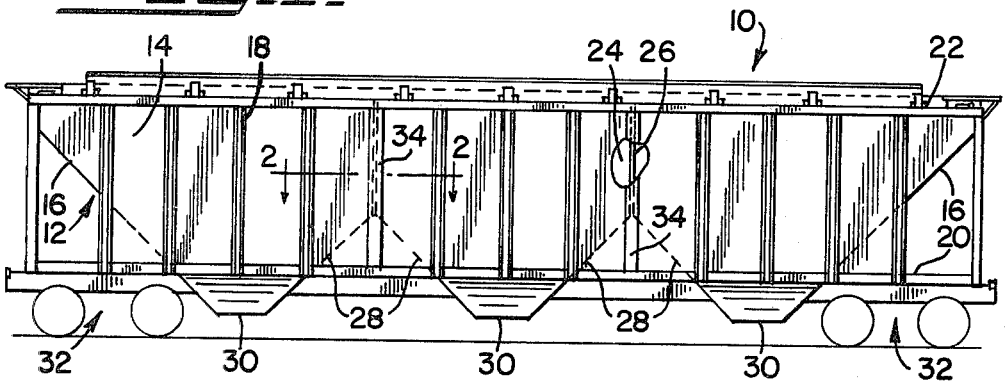
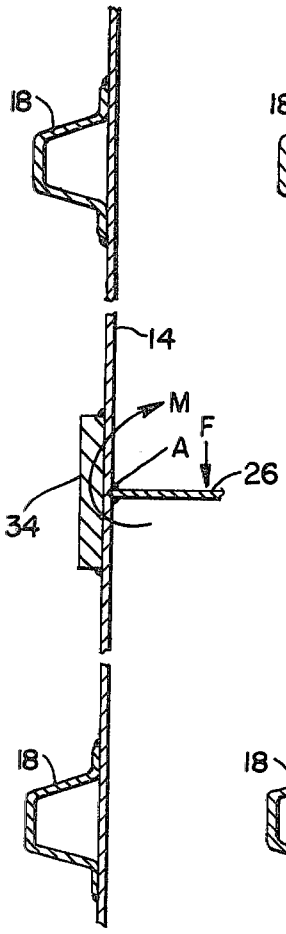
FIG. 2
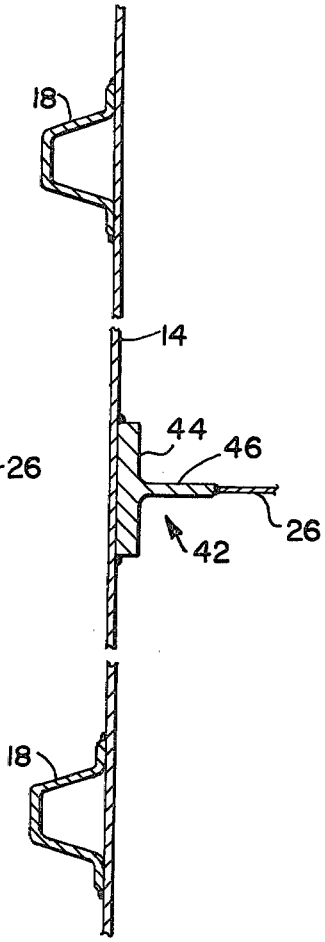
FIG. 3
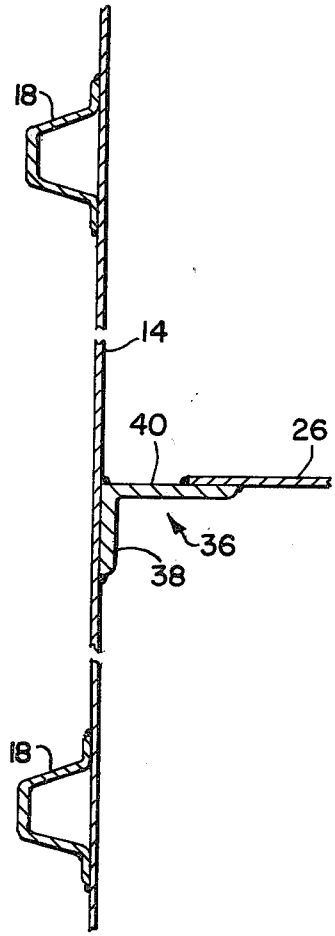
FIG. 4

PARTITION SHEET TO SIDE SHEET CONNECTION FOR COVERED HOPPER CARS

BACKGROUND OF THE INVENTION

1. Field of the Invention

The invention relates to railway cars and particularly to connections of partition sheets at their vertical edge portions to side sheets.

2. Description of the Prior Art

The prior art includes partition sheets that divide covered railway hopper cars into compartments. The partition sheets are connected along their vertical edge portions to the internal side of side sheets. In the area of this connection, on the external side of the side sheet, is a hat shaped vertical side post. These side posts have their open portions abutting the side sheet.

Forces created during the coupling-uncoupling operation of railway cars and during acceleration cause loads which the partition sheets must restrain. To restrain these loads the partition sheet flexes, much like a membrane. As the partition sheet flexes a corresponding moment force is produced in the area of the partition sheet to side sheet connection. If as the partition sheet flexes, the side sheet rotates, stress build-up will be minimal. If not, stresses will build in the partition sheet at its connection to the side sheet, leading to fatigue fractures.

The hat shaped vertical side post with its open portion abutting the side sheet acts as a rotational stiffener to the side sheet in their area of contact. The side sheet is therefore restrained from rotating as the partition sheet flexes. This causes a high degree of stress concentration in the partition sheet in the area of its connection with the side sheet causing premature fatigue cracking under cyclic flexing.

The present invention is an improvement over the prior art by reducing the stress concentration in the area of the partition sheet connection to the side sheet. This is accomplished by replacing the hat shaped vertical side post in the area of the partition sheet connection with a stress reducing internal or external post member which provides less rotational restraint.

SUMMARY OF THE INVENTION

In the present invention a covered railway hopper car includes a plurality of generally vertical partition sheets. These partition sheets act as compartment dividers, stiffening elements and load restraining devices. The attachment of the vertical edges of the partition sheet to side sheets in the present invention is accomplished so as to reduce stress concentration therein preventing fracture.

Partition sheet to side sheet connections of the prior art have the hat shaped vertical side post in the area of said connection. The hat shaped side post acts as a stiffener to the side sheet. This prevents the side sheet from rotating as the partition sheet is flexed causing fractures therein.

To reduce stress concentrations in the partition sheet to side sheet connections, a stress reducing post member is used. This post member replaces the hat shaped vertical post in the area of the partition sheet to side sheet connection. The post member, either internal or external, adds little torsional resistance to the side sheet. This allows the side sheet to rotate as the partition sheet flexes thereby reducing the moment in the connection and therefore fatigue fractures under cyclic loading.

The new post member acts to reduce premature fractures in partition sheets by interconnecting the partition sheet to the side sheet. This moves the point of connection of the partition sheet to side framing members to an area where the moment force is decreased. Further, the new post member provides a greater cross-section in the area of the greatest moment forces to resist fatigue.

BRIEF DESCRIPTION OF THE DRAWINGS

FIG. 1 is a side elevation view of a covered railway hopper car, embodying the invention;

FIG. 2 is a portion of a section taken along line 2—2 showing one of the embodiments;

FIG. 3 is a portion of a section taken along line 2—2 showing another of the embodiments;

FIG. 4 is a portion of a section taken along line 2—2 showing another of the embodiments.

DESCRIPTION OF THE PREFERRED EMBODIMENTS

FIG. 1 discloses a covered railway hopper car generally designated by reference numeral 10. The covered hopper 10 includes a car body 12 having vertical side sheets 14. Connected to opposite ends of the side sheets 14 are end walls 16 which slope downwardly. Vertical hat shaped side posts 18 of the usual type are spaced generally equidistant about the side sheets 14. The side posts 18 extended between side sills 20 and side plates 22 are connected thereto. The hoppers 24 include partition sheets 26 and downwardly sloping sheets 28 leading to discharge openings 30. The car body 12 is supported on conventional wheel trucks generally designated by numeral 32.

FIG. 2 is a section taken along line 2—2 of FIG. 1 and discloses one embodiment of the present invention. The vertical hat shaped side post 18 in the area of the partition sheet 26 to side sheet 14 connection is replaced by a torsionally flexible post 34. This flexible post 34 provides necessary framing requirements for the hopper car 10 in addition to offering little or no torsional resistance to side sheet 14 rotation. Therefore, in this arrangement when the partition sheet 26 is under load F and is caused to flex, the accompanying moment force M in side sheet 14 is not resisted. This allows the side sheet 14 to rotate about point A reducing stresses in the partition sheet 26 at the side sheet connection thereby improving fatigue characteristics.

Another embodiment of the present invention is shown in FIG. 4 which is taken along line 2—2 of FIG. 1. Again the vertical hat shaped side post of the prior art is replaced by internal post 36. The internal post 36 has its base 38 along and in abutment with the internal side of the side sheet 14 and is rigidly affixed thereto. Extending generally at right angles from one end of the base 38 is an outstanding leg 40. The partition sheet 26 is rigidly attached to leg 40 of post 36 in an overlapping arrangement. In this embodiment the internal post 36 offers little or no resistance to the side sheet 14 rotating under moment forces. It also removes the partition sheet connection from the area of the maximum moment forces created by partition sheet loading. Further, the post 36 provides a greater cross-section in the area of the maximum moment forces and may provide improved fatigue resistance.

Referring to FIG. 3 another embodiment of the present invention is shown. This view is taken along line 2—2 of FIG. 1. In this embodiment the hat shaped vertical side post 18 in the area of the partition sheet to side sheet connection is replaced by internal post member 42. Post member 42 is T-shaped having its base 44 along and in abutment with the internal side of side sheet 14 and is rigidly affixed thereto. An outstanding leg 46 of post member 42 extends at generally right angles from the base 44 intermediate the ends thereof. The partition sheet 26 has its vertical edge portions abutting and rigidly attached to the end of the leg 46.

In the embodiment of FIG. 3 as in the embodiment of FIG. 4 the side sheet 14 receives little or no torsional resistance to moment forces from the post member 42. Further post member 42 removes the partition sheet connection from the area of maximum moment forces and provides a greater cross-section to resist fatigue.

The foregoing description and drawings merely explain and illustrate the invention and the invention is not limited thereto, except insofar as the appended claims are so limited, or those skilled in the art who have the disclosure before them will be able to make modifications and variations therein without departing from the scope of the invention.

What is claimed is:

1. A railway hopper car including a car body having transversely spaced vertical side sheets, a plurality of diagonally extending slope sheets connected to said side sheets and forming a plurality of hoppers having lower discharge openings, and a plurality of partition sheets having laterally spaced vertical side portions for compartmentalizing said hoppers, the improvement comprising;

means for connecting each side portion of each partition sheet to said side sheets within said car, said vertical side portions spaced from said side sheet, said means including a post connected to a side sheet and extending vertically therewith, said post having an outwardly extending leg, said vertical side portions being rigidly connected with said legs, and said means for connecting enhancing side sheet rotation upon loading of said partition sheet thereby reducing fatigue fractures in said side sheet to partition sheet connection.

2. The invention in accordance with claim 1, said post including a base rigidly connected to said side sheet within said car, and said outwardly extending leg being generally perpendicular to said base and extending from one end of said base.

3. The invention in accordance with claim 2, said partition sheet including opposite vertical end portions overlapping end portions of said outwardly extending leg and being rigidly affixed thereto.

4. The invention in accordance with claim 1, said post including a base rigidly connected to said side sheet within said car and said outwardly extending leg being generally perpendicular to said base and extending intermediate the ends of the base.

5. The invention in accordance with claim 4, said partition sheet end portions abutting the end portions of said outwardly extending legs and being rigidly affixed thereto.

6. The invention in accordance with claim 1, said post being of T-shaped configuration and being torsionally flexible.

7. A railway hopper car including a car body having transversely spaced vertical side sheets, a plurality of diagonally extending slope sheets connected to said side sheets and forming a plurality of hoppers having lower discharge openings, and a plurality of partition sheets having laterally spaced vertical side portions for compartmentalizing said hoppers, the improvement comprising;

means for connecting each side portion of each partition sheet to said side sheets of said car, torsionally resistant hat shaped vertical side posts rigidly connected to said side sheets and extending vertically therewithin externally of said car, said hat shaped side posts being situated fore and aft of said means for connecting longitudinally of said car and said means including a metal plate member substantially vertically coextensive with said side sheet and connected adjacent to said side portion of said partition sheet whereby rotation of said side sheet is facilitated thereby reducing stress concentrations in said partition sheet to side sheet connections.

8. The invention in accordance with claim 7, said metal plate member being a flat plate external of said car and forming a T with said partition sheet at its connection with said side sheet.

9. The invention in accordance with claim 7, said vertical side portions spaced from said side sheet, and said metal plate member being an angle plate connected within said car between said partition sheet and said side sheet.

10. The invention in accordance with claim 9, said angle plate including a first flange rigidly connected to said side sheet, and a second flange connected to one end of said first flange and extending generally at right angles therefrom.

11. The invention in accordance with claim 10, said side portion of said partition sheet overlapping and being rigidly affixed to said second flange.

12. The invention in accordance with claim 7, said vertical side portions spaced from said side sheet, and said metal plate member being a T shaped plate connected within said car between said partition sheet and said side sheet.

13. The invention in accordance with claim 12, said T shaped plate including a first flange rigidly connected with said side sheet, and a second flange connected intermediate the ends of said first flange and extending generally at right angles therefrom and including a generally vertical end portion.

14. The invention in accordance with claim 13, said side portion of said partition sheet having opposite generally vertical end portions abutting and rigidly connected to said generally vertical end portion of said second flange.

* * * * *